US010030871B2

(12) United States Patent
Stanton et al.

(10) Patent No.: US 10,030,871 B2
(45) Date of Patent: Jul. 24, 2018

(54) COMBUSTION MONITORING

(71) Applicant: Edwards Limited, Crawley, West Sussex (GB)

(72) Inventors: Gareth David Stanton, Clevedon (GB); Duncan Michael Price, Wells (GB)

(73) Assignee: Edwards Limited, Burgess Hill (GB)

( * ) Notice: Subject to any disclaimer, the term of this patent is extended or adjusted under 35 U.S.C. 154(b) by 16 days.

(21) Appl. No.: 14/891,365

(22) PCT Filed: Apr. 16, 2014

(86) PCT No.: PCT/GB2014/051188
§ 371 (c)(1),
(2) Date: Nov. 16, 2015

(87) PCT Pub. No.: WO2014/188154
PCT Pub. Date: Nov. 27, 2014

(65) Prior Publication Data

US 2016/0076769 A1 Mar. 17, 2016

(30) Foreign Application Priority Data

May 30, 2013 (GB) ..... 1309010.5

(51) Int. Cl.
*F23D 14/14* (2006.01)
*F23N 3/00* (2006.01)
(Continued)

(52) U.S. Cl.
CPC ..... *F23N 3/002* (2013.01); *F23C 99/006* (2013.01); *F23D 14/14* (2013.01); *F23D 14/16* (2013.01);
(Continued)

(58) Field of Classification Search
USPC ..... 431/13; 423/240 R
See application file for complete search history.

(56) References Cited

U.S. PATENT DOCUMENTS 4,059,385 A 11/1977 Gulitz et al.
4,168,785 A * 9/1979 Gabler ..... F23M 11/045 110/179
(Continued)

FOREIGN PATENT DOCUMENTS

EP 0735322 10/1996
EP 0735322 A2 * 10/1996 ..... F23G 7/065
(Continued)

OTHER PUBLICATIONS

Wiesenberg Machine Translation; Accessed by Examiner on Apr. 14, 2017; http://translationportal.epo.org/emtp/translate/?Action=description-retrieval&Country=EP&Engine=google&Format=docdb&Kind=A2&Locale=en_EP&Number=0735322&OPS=ops.epo.org/3.2&SRCLANG=de&TRGLANG=en.*
(Continued)

*Primary Examiner* — Avinash Savani
(74) *Attorney, Agent, or Firm* — Shaoni L. Mitchell

(57) ABSTRACT

A radiant burner and method are disclosed. The radiant burner is for treating an effluent gas stream from a manufacturing process tool and comprises: a combustion chamber having a porous sleeve through which combustion materials pass for combustion proximate to a combustion surface of the porous sleeve; a combustion characteristic monitor operable to determine combustion performance of the radiant burner by monitoring infra-red radiation emitted from the combustion surface; and a radiant burner controller operable to control operation of the radiant burner in dependence upon combustion performance determined by the combustion characteristic monitor. Accordingly, aspects recognize that if a burner is suffering from an excessive flow of air the
(Continued)

burner pad or combustion surface will typically cool, which results in an increase in unwanted emissions in the exhaust produced by a radiant burner. The cooling also results in a reduction in infrared radiation determined by the combustion surface. The hydrogen flame of the radiant burner and the hydrocarbon flame of the burner pilot typically do not emit infrared radiation and thus a change in infra-red an radiation, for example, intensity, quantity or frequency, emitted by the combustion surface of the radiant burner can be used to diagnose an "overflow" of cold gas, typically air, in the combustion mixture fed into the system, for example, the combustion chamber. Once diagnosed appropriate ameliorative steps may be taken and, for example, the burner control logic may be operable to compensate by reducing air flow into the burner.

11 Claims, 2 Drawing Sheets

(51) Int. Cl.

| | |
|---|---|
| ***F23N 5/08*** | (2006.01) |
| ***F23N 5/24*** | (2006.01) |
| ***F23C 99/00*** | (2006.01) |
| ***F23D 14/16*** | (2006.01) |
| ***F23G 7/06*** | (2006.01) |

(52) U.S. Cl.
CPC ..... *F23G 7/06* (2013.01); *F23G 7/065* (2013.01); *F23N 5/08* (2013.01); *F23N 5/082* (2013.01); *F23N 5/24* (2013.01); *F23N 5/242* (2013.01); *F23G 2209/142* (2013.01)

(56) References Cited

U.S. PATENT DOCUMENTS

| | | | | | |
|---|---|---|---|---|---|
| 4,505,668 | A * | 3/1985 | DiBiano | F23G 7/085 | 431/202 |
| 4,721,456 | A * | 1/1988 | Granberg | F23D 14/145 | 29/428 |
| 5,112,217 | A * | 5/1992 | Ripka | F23N 1/022 | 431/12 |
| 5,603,905 | A * | 2/1997 | Bartz | F23D 14/16 | 110/236 |
| 5,980,238 | A * | 11/1999 | Collins, Sr. | F21S 13/10 | 431/18 |
| 6,042,365 | A * | 3/2000 | Chen | F23N 5/082 | 431/12 |
| 9,377,190 | B2 * | 6/2016 | Karkow | F23D 14/74 | |
| 9,562,682 | B2 * | 2/2017 | Karkow | F23D 14/74 | |
| 2004/0028590 | A1 * | 2/2004 | Tsuji | F23D 14/74 | 423/245.3 |
| 2006/0104878 | A1 * | 5/2006 | Chiu | F23G 5/50 | 423/240 R |
| 2007/0234730 | A1 * | 10/2007 | Markham | G01N 21/359 | 60/772 |
| 2008/0233523 | A1 * | 9/2008 | Diepenbroek | F23G 5/50 | 431/14 |
| 2011/0008737 | A1 | 1/2011 | McManus et al. | | |
| 2011/0062056 | A1 | 3/2011 | Tate et al. | | |
| 2015/0276212 | A1 * | 10/2015 | Karkow | F23D 14/74 | 431/253 |
| 2016/0003471 | A1 * | 1/2016 | Karkow | F23C 5/06 | 431/2 |
| 2016/0153655 | A1 * | 6/2016 | Seeley | F23C 99/006 | 431/5 |

FOREIGN PATENT DOCUMENTS

| | | | | |
|---|---|---|---|---|
| JP | 09-079571 | A | 3/1997 | |
| JP | 2002-162028 | A | 6/2002 | |
| WO | 2008122819 | A1 | 10/2008 | |
| WO | WO 2008122819 | A1 * | 10/2008 | F23C 99/006 |

OTHER PUBLICATIONS

International Search Report and Written Opinion dated Jun. 13, 2014 in corresponding International Application No. PCT/GB2014/051188, 11 pgs.

Combined Search and Examination Report under Sections 17 and 18(3) dated Dec. 17, 2013 in GB Application GB1309010.5, 7 pgs.

Office Action, and translation thereof, from counterpart Japanese Patent Application No. 2016-514471 dated Jan. 9, 2018. pages.

Office Action and translation thereof from counterpart Chinese Patent Application No. 201480029418.3 dated Mar. 12, 2018.

* cited by examiner

COMBUSTION MONITORING

This application is a national stage entry under 35 U.S.C. § 371 of International Application No. PCT/GB2014/051188, filed Apr. 16, 2014, the entire content of which is incorporated herein by reference.

TECHNICAL FIELD OF THE INVENTION

The present invention relates to a radiant burner and method.

BACKGROUND

Radiant burners are known and are typically used for treating an effluent gas stream from a manufacturing process tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity compared to carbon dioxide.

It will be appreciated that various semiconductor or flat panel display manufacturing no processes are utilised. For example, processes such as chemical vapour deposition, epitaxial processes and etching processes may be used and each will have an associated effluent gas stream. Various radiant burners are provided for treatment of those effluent gas streams. It will be appreciated that an appropriate gas burner may be chosen in dependence upon requirements of manufacturing processes.

For example, in the case of chemical vapour deposition manufacturing techniques, a simple radiant burner may be used, whereas a radiant burner used to process effluent gases from epitaxial manufacturing processes may comprise a high flow hydrogen burner, and a suitable radiant burner for processing effluent gases produced by etching processes may comprise a radiant burner and a high-intensity flame provided at the end of a nozzle which introduces effluent into a combustion chamber.

Known radiant burners use combustion to remove the PFCs and other compounds from the effluent gas stream. Such radiant burners typically comprise, a combustion chamber laterally surrounded by an exit surface of a foraminous gas burner. Fuel gas and air are simultaneously supplied to the foraminous burner to effect flameless combustion at the exit surface, with the amount of air passing through the foraminous burner being selected, depending upon application, to be sufficient to consume the fuel gas supplied to the burner, and also as required, any combustibles which may be injected into the combustion chamber.

Effluent gas is introduced into the combustion chamber and, depending on application, the conditions within the combustion chamber may be such that hot gases resulting front the combustion processes may act on the effluent gas and react to form a species which are safe or can be removed via wet scrubbing. Typically, the effluent gas stream is a nitrogen stream in containing PFCs.

As the surface areas of the semiconductors being produced increases, the flow rate of the effluent gas also increases.

Although techniques exist for processing the effluent gas stream, they each have their own shortcomings. Accordingly, it is desired to provide an improved technique for monitoring and controlling operation of a radiant burner.

SUMMARY OF THE INVENTION

A first aspect provides a radiant burner for treating an effluent gas stream from a manufacturing process tool, the radiant burner comprising: a combustion chamber having a porous sleeve through which combustion materials pass for combustion proximate to a combustion surface of the porous sleeve; a combustion characteristic monitor operable to determine combustion performance of the radiant burner by monitoring infra-red radiation emitted from the combustion surface; and a radiant burner controller operable to control operation of the radiant burner in dependence upon combustion performance determined by the combustion characteristic monitor.

As described above, various radiant burners are provided to treat effluent gases which result from manufacturing processes such as chemical vapour deposition, epitaxial processes and etching processes.

Chemical vapour deposition processes are typically such that their effluent gas is treated in a simple radiant burner. In such a scenario, effluent gas may be introduced at 90 degrees to a combustion surface. The radiant burner provided acts to combust fuel and air at its combustion surface in the absence of effluent gas. Resulting hot gas containing nitrogen, argon, oxygen, water and carbon dioxide acts on any effluent gas from CVD processing and reacts to form species which are safe or can be removed via wet scrubbing techniques. For example:

$$SiH_{4(g)}+2O_{2(g)}+\text{heat}\rightarrow SiO_{2(g)}+2H_2O_{(g)}$$

Epitaxial manufacturing processes may produce effluent gases to be treated with a high flow hydrogen burner. In such cases, considerable hydrogen flows are switched on and off, which changes the amount of oxygen required for combustion at the combustion surface of any radiant burner provided to treat the effluent as flows. It will be understood that the hydrogen flows which are used in the epitaxial processes can cause disruptions to treatment of the effluent gases, and any radiant burner provided to treat the effluent gases may include means to compensate for such hydrogen flows.

Finally, in the case of etching manufacturing processes, effluent gases may be treated by a radiant burner which includes a high-intensity flame. That is to say, the combustion system comprises an open flame pilot burner, a radiant burner and a series of high-intensity open flames created at the end of a process nozzle. For example:

$$CF_4+2H_2O+\text{Heat}\rightarrow CO_2+4HF$$

Maintaining efficient operation of a radiant burner is complex. Running a radiant burner in a manner which is inappropriate or unsuited to a manufacturing process may result in poor combustion leading to high emissions and inefficient treatment of an effluent stream. It will be appreciated that hydrogen and carbon monoxide emissions are an environmental concern and that ensuring efficient operation of a radiant burner may help to control such emissions.

Aspects described herein recognise that a problem with operating a radiant burner according to a "standard" or "normal" set of operating parameters can lead to inefficient burner operation and that it is possible to provide a radiant burner which is operable to adjust operational parameters to address, for example, an increase or decrease in the flow rate of the effluent gas through the radiant burner, an apparent lack of combustion at the foraminous burner exit surface, and analysis of chemical processes leading to an overall improvement in radiant burner operation, by means of monitoring and determining (i.e. characterising) combustion performance (combustion properties) as a result of monitoring infra-red radiation emitted from the combustion surface of the radiant burner.

Accordingly, a gas abatement apparatus or radiant burner is provided. The radiant burner may treat an effluent gas stream from a manufacturing process tool. The radiant burner may comprise a combustion chamber. The combustion chamber may have a porous or permeable sleeve through which combustion materials pass. The combustion materials may combust proximate to, near to or adjacent a combustion surface of the porous sleeve. One or more effluent nozzles may be provided which eject the effluent gas stream into the combustion chamber. According to aspects described herein the radiant burner may further comprise a combustion characteristic monitor operable to determine combustion performance of the radiant burner by monitoring infra-red radiation emitted from the combustion surface. The radiant burner may also comprise a radiant burner controller operable to control operation of the radiant burner in dependence upon combustion performance determined by the combustion characteristic monitor.

Aspects recognise that, whilst it may be beneficial to have precise details of the manufacturing process which is generating effluent gases to be processed by a radiant burner so that operating parameters of the radiant burner can be adjusted accordingly, that information may not always be available when configuring and commissioning a radiant burner and, for example, may change over time. The interface signal between a radiant burner and a manufacturing process may often be difficult or expensive to achieve and aspects allow an interface signal between processing and the radiant burner to be generated.

Typically, a radiant burner is monitored as part of ensuring that it is operating safely. There may, for example, be a legal requirement to monitor a radiant burner. In known radiant burners it is possible to use a flame ionisation detector to monitor for operation of a pilot flame and to use a thermocouple to monitor operation of the main radiant burner or the combustion zone.

It will be appreciated that such monitoring techniques are not without problems. For example, a thermocouple is not be operable to discriminate between heat generated by the main radiant burner and heat generated by any other source within the combustion zone. Typically, a thermocouple is placed within the combustion zone and therefore needs to be able to withstand corrosion. As a result, thermocouples provided, in the combustion zone are typically made particularly robust and, thus, the thermocouple typically has a degree of hysteresis or "lag time" when heating and cooling. That hysteresis may be made worse by deposition of effluent reaction products such as silica on the surface of the thermocouple. Readings from a thermocouple may therefore be unreliable or not provide a prompt signal upon which action to change operation of the radiant burner may be taken.

Aspects described herein recognise that infrared light is generated as a function of the operation of a radiant burner. The combustion zone approximate to the combustion surface heats the combustion surface pad material. The combustion surface in turn acts as a heat exchanger, heating incoming gases into the combustion chamber to beyond their auto-ignition temperature. The precise location of the combustion zone is governed by, for example, the velocity of incoming gas and ignition delay of a fuel gas mixture fed to the radiant burner.

Aspects recognise that by monitoring infrared radiation emitted from the combustion surface, various characteristics of what might be occurring within the combustion chamber may be determined to indicate how the burner is performing.

It will be appreciated that an infrared detector will typically respond more quickly to burner switch-on than a thermocouple and pilot monitoring arrangement.

Furthermore, infrared monitoring is unlikely to be subject to the same degree of hysteresis as monitoring using a thermocouple. As a result, use of an infrared detector go may improve recovery or response time of a system which may be important if the radiant burner is being used as a back-up system. It may be possible, for example, to improve the recovery time of a system from in the region of in seconds (from cold) or approximately 60 seconds (from hot) to less than 5 seconds by using an infrared detector rather than a thermocouple and ionisation detector.

Aspects also recognise that if a burner is suffering from excessive flows of air the burner pad or combustion surface will typically cool, which results in an increase in unwanted burner emissions and a reduction in infrared radiation determined by the combustion surface. If present, a nozzle flame of a radiant burner and the hydrocarbon flame of a burner pilot typically do not emit infrared radiation and thus a change in infra-red radiation, for example, intensity, quantity or frequency, emitted by the combustion surface of the radiant burner can be used to diagnose an "overflow" of cold gas, typically air, in the combustion mixture fed into the system, for example, the combustion chamber. Once diagnosed appropriate ameliorative steps may be taken and, for example, the burner control logic may be operable to compensate by reducing air flow into the burner.

It will be appreciated that aspects and embodiments described may provide, in some implementations, a simple "off switch" in relation to a mode of operation of the radiant burner in which excess air is determined to be fed to the combustion chamber.

Furthermore, by monitoring infra-red radiation emitted by the combustion pad, a non-invasive means of monitoring burner operation may be provided, meaning that monitoring processes may be performed through, for example, an existing sight glass provided at a radiant burner. Aspects may allow for burner monitoring without a need to directly interact with a process gas stream. By not being provided or located within the combustion chamber or combustion zone, an infrared detector is not likely to be prone to the deposition of effluent reaction products in the same way as a thermocouple. It is thus possible that an infrared detector is less likely to give false negative or positive signals, causing unnecessary shutdown of a combustion system.

The combustion, characteristic monitor may comprise a detector and an analysis unit. The analysis unit may form part of a burner control unit.

According to one embodiment, the combustion characteristic monitor is operable to determine whether the infrared radiation emitted by the combustion surface lies within acceptable operational parameters. Those parameters may comprise a range of acceptable values indicative of optimal burner operation.

According to one embodiment, if the combustion performance determined by the combustion characteristic monitor is determined to lie outside acceptable operational parameters, the radiant burner controller is operable to initiate one or more ameliorative actions.

According to one embodiment, the ameliorative actions comprise: initiation of radiant burner shutdown or activation of a user alarm. Furthermore, according to some embodiments, operational performance characteristics of the radiant burner may be adapted to change the infrared emissions from the combustion surface and try to bring them closer to those indicative of optimal burner operation.

According to one embodiment, the radiant burner controller is operable to control the combustion materials fed to the radiant burner combustion surface in dependence upon the combustion performance determined by the combustion characteristic monitor. The combustion materials may comprise a mix of fuel, for example, fuel gas (such as methane, natural gas, hydrogen), and air.

According to one embodiment, the radiant burner controller is operable to increase or decrease a feed rate of at least one of the combustion materials fed to the radiant burner combustion surface in dependence upon the combustion performance determined by the combustion characteristic monitor. Accordingly the rate at which fuel is supplied or air is supplied to the burner may be adjusted in dependence upon monitored IR radiation emitted by the combustion surface.

According to one embodiment, the radiant burner controller is operable to control a composition of the combustion materials fed to the radiant burner combustion surface in dependence upon the combustion performance determined by the combustion characteristic monitor.

According to one embodiment, radiant burner controller is operable to increase or decrease a ratio of fuel to air in the combustion materials fed to the radiant burner combustion surface in dependence upon the combustion performance determined by the combustion characteristic monitor.

According to one embodiment, the combustion characteristic monitor is operable to determine combustion performance of the radiant burner by monitoring one or more infra-red radiation wavelength indicative of desired operation parameters of the radiant burner.

According to one embodiment, the combustion characteristic monitor is operable to determine combustion performance of the radiant burner by monitoring one or more infra-red radiation wavelength between, 400 nm and 1100 nm, indicative of desired operation parameters of the radiant burner.

According to one embodiment, the combustion characteristic monitor is operable to determine combustion performance of the radiant burner by monitoring intensity of radiation received at one or more infra-red radiation wavelengths indicative of desired operation parameters of the radiant burner at that wavelength.

According to one embodiment, the combustion characteristic monitor is operable to determine combustion performance of the radiant burner by monitoring intensity of radiation received at one or more infra-red radiation wavelengths between 400 nm and 1100 nm, in particular around 800 nm, indicative of desired operation parameters of the radiant burner at that wavelength.

According to one embodiment, the combustion characteristic monitor is operable to determine combustion performance of the radiant burner by monitoring a ratio between intensity of radiation received at one or more infra-red radiation wavelengths indicative of desired operation parameters of the radiant burner at that wavelength.

According to one embodiment, the combustion characteristic monitor is operable to monitor electromagnetic radiation emitted by the combustion surface and determine combustion performance of the radiant burner by performing spectroscopic analysis in relation to that monitored electromagnetic spectrum. Accordingly, in some embodiments, a region of electromagnetic spectrum may be monitored outside and inside the infra-red region. It may be possible to analyse in some embodiments, the processes occurring within a combustion chamber. For example, it may be possible to identify products which may be forming m the combustion chamber. Accordingly, in some embodiments it may be possible to control the additives to an effluent gas stream to be treated by the radiant burner in response to a spectrographic analysis of material within the combustion chamber. For example, fuel and/or oxidant ma be added by introduction to the effluent gas stream in response to in situ non-invasive analysis performed across a monitored region of electromagnetic spectrum emitted by the combustion surface.

According to one embodiment, the combustion characteristic monitor and the radiant burner controller are operable to continuously monitor and control operation of the radiant burner thereby operating to form a feedback loop of operation.

A second aspect provides a method of monitoring and controlling operation of a radiant burner for treating an effluent gas stream from a manufacturing process tool, the radiant burner comprising a combustion chamber having a porous sleeve through which combustion materials pass for combustion, proximate to a combustion surface of the porous sleeve; the method comprising: monitoring infra-red radiation emitted from the combustion surface to determine combustion performance of the radiant burner; and controlling operation of the radiant burner in dependence upon combustion performance determined by the monitoring.

According to one embodiment, the method further comprises determining whether the infra-red radiation emitted by the combustion surface lies within acceptable operational parameters.

According to one embodiment, if the combustion performance is determined to lie outside acceptable operational parameters, initiating one or more ameliorative actions.

According to one embodiment, the ameliorative actions comprise: initiation of radiant burner shutdown or activation of a user alarm.

According to one embodiment, the method further comprises controlling the combustion materials fed to the radiant burner combustion surface in dependence upon the combustion performance determined.

According to one embodiment, the method comprises increasing or decreasing a feed rate of the combustion materials fed to the radiant burner combustion surface in dependence upon the combustion performance determined.

According to one embodiment, the method comprises controlling a composition of the combustion materials fed to the radiant burner combustion surface in dependence upon the combustion performance determined.

According to one embodiment, the method comprises increasing or decreasing a ratio of fuel to air in the combustion materials fed to the radiant burner combustion surface in dependence upon the combustion performance determined.

According to one embodiment, the method comprises monitoring one or more infra-red radiation wavelength indicative of desired operation parameters of the radiant burner.

According to one embodiment, the method comprises monitoring the intensity of radiation received at one or more infra-red radiation wavelengths indicative of desired operation parameters of the radiant burner at that wavelength.

According to one embodiment, the method comprises monitoring a ratio between intensity of radiation received at one or more infra-red radiation wavelengths indicative of desired operation parameters of the radiant burner at that wavelength.

According to one embodiment, the method comprises monitoring electromagnetic radiation emitted by the combustion surface and determine combustion performance of the radiant burner by performing spectroscopic analysis in relation to that monitored electromagnetic spectrum.

According to one embodiment, the method comprises continuously monitoring and controlling operation of the radiant burner thereby operating to form a feedback loop of operation.

A third aspect provides a radiant burner combustion monitor for use with a radiant burner for treating an effluent gas stream from a manufacturing process tool, the radiant burner comprising: a combustion chamber having a porous sleeve through which combustion materials pass for combustion proximate to a combustion surface of the porous sleeve; the combustion monitor comprising: an infra-red radiation monitor arranged to monitor infrared radiation emitted from a combustion surface of the radiant burner and determine combustion performance of the radiant burner based on those emissions; the infra-red radiation monitor being coupleable to a radiant burner controller operable to control operation of the radiant burner in dependence upon combustion performance determined by the infra-red radiation monitor.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

Other preferred and/or optional aspects of the invention are defined in the accompanying claims.

BRIEF DESCRIPTION OF THE DRAWINGS

In order that the present invention may be well understood, an embodiment thereof, which is given by way of example only, will now be described with reference to the accompanying drawing, in which.

DETAILED DESCRIPTION OF THE EMBODIMENTS

Radiant Burner—General Configuration and Operation

Figure 1:
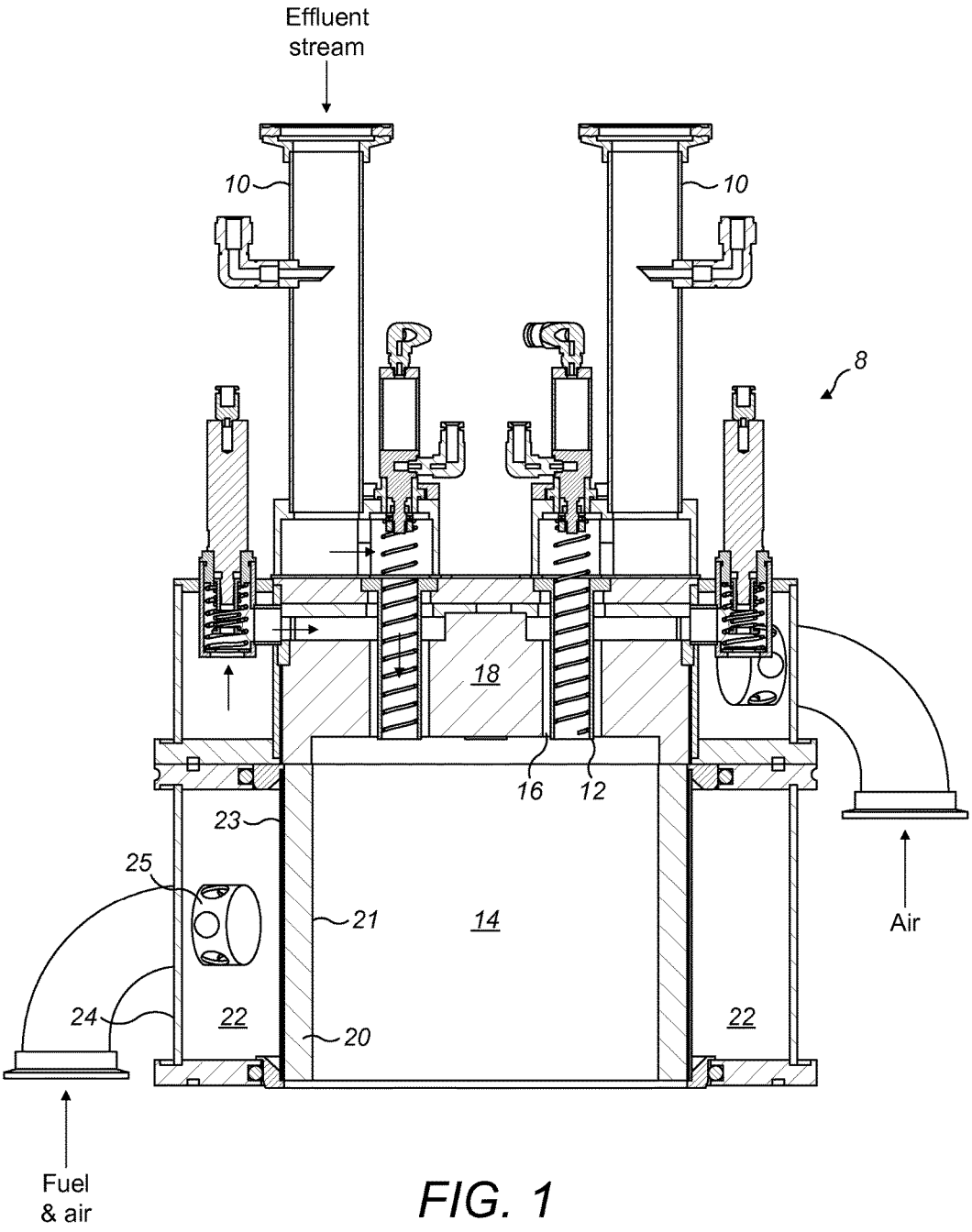
FIG. 1 illustrates a typical radiant burner.
Figure 2:
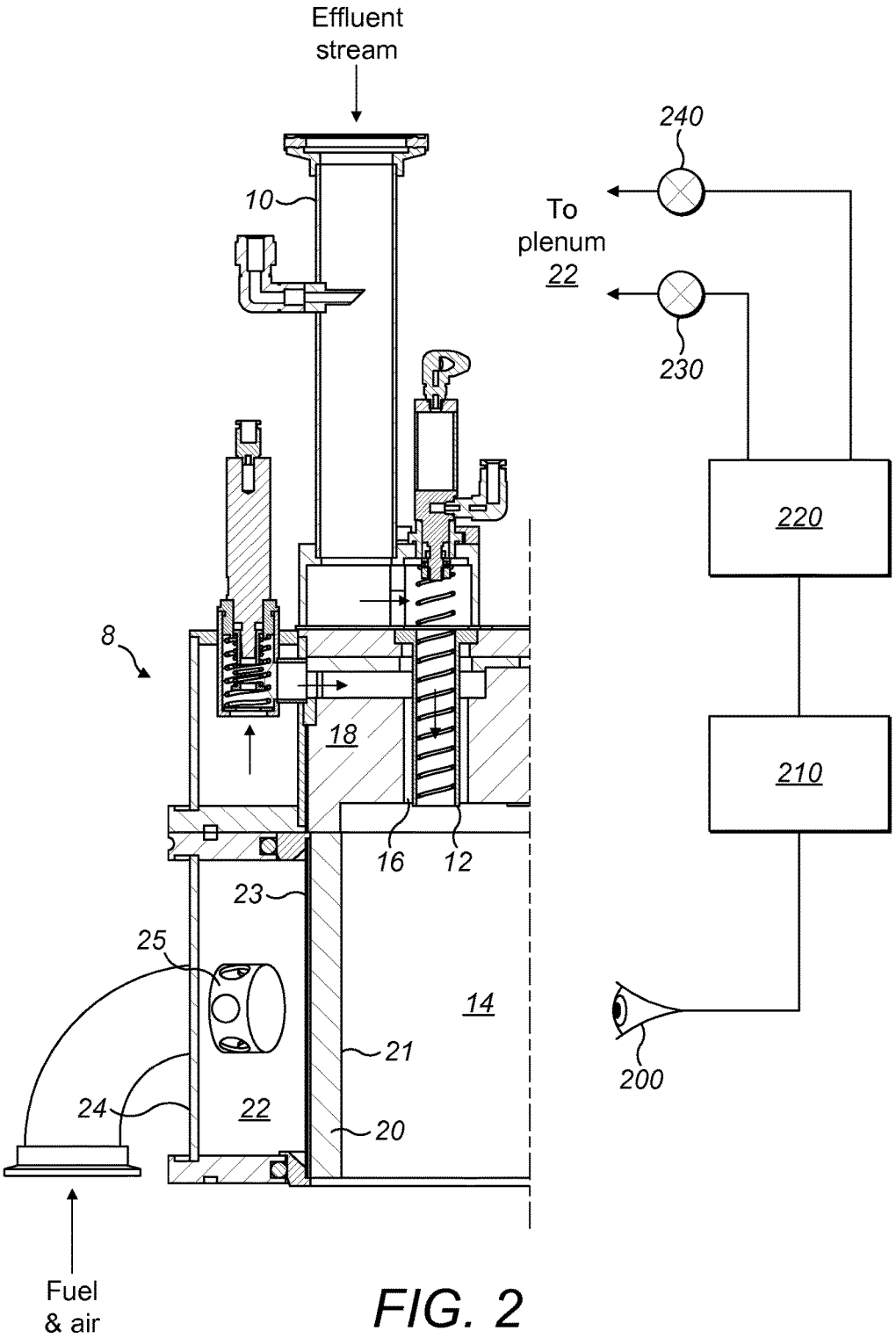
FIG. 2 illustrates schematically some components of a radiant burner according to one embodiment.

FIG. 1 illustrates a radiant burner, generally 8. The radiant burner 8 treats an effluent gas stream pumped from a manufacturing process tool such as a semiconductor or flat panel display process tool typically by means of a vacuum pumping system. The radiant burner shown in FIGS. 1 and 2 is of the type typically used to treat effluent gases from a chemical vapour deposition manufacturing process. The effluent stream is received at inlets 10. The effluent stream is conveyed from the inlet 10 to a nozzle 12 which injects the effluent stream into a cylindrical combustion chamber 14. In this embodiment, the radiant burner 8 comprises four inlets 10 arranged circumferentially, each conveying an effluent stream pumped from a respective tool by a respective vacuum pumping system. Alternatively, the effluent stream from a single process tool may be split into a plurality of streams, each one of which is conveyed to a respective inlet 10. Each nozzle 12 is located within a respective bore 16 formed in a ceramic top plate 18 which defines an upper or inlet surface of the combustion chamber 14.

The combustion chamber 14 has sidewalls defined by an exit surface 21 of a foraminous burner element 20 such as that described in EP 0 694 735. The burner element 20 is cylindrical and is retained within a cylindrical outer shell 24. A plenum volume 22 is defined between an entry surface 23 of the burner element 20 and the cylindrical outer shell 24. A mixture of fuel gas, such as natural gas or a hydrocarbon, and air is introduced into the plenum volume 22 via one or more inlet nozzles 25. The mixture of fuel gas and air passes from the entry surface 23 of the burner element 20 to the exit surface 21 of the burner element 20 for combustion within the combustion chamber 14.

The ratio of the mixture of fuel gas and air may be varied to vary the temperature within the combustion chamber 14 to that which is appropriate for the effluent gas stream to be treated. Also, the rate at which the mixture of fuel gas and air is introduced into the plenum volume 22 can be adjusted so that the mixture will burn without visible flame at the exit surface 21 of the burner element 20. The exhaust of the combustion chamber 14 may be open to enable the combustion products to be output from the radiant burner 8.

Accordingly, it can be seen that the effluent gas received through the inlets 10 and provided by the nozzles 12 to the combustion chamber 14 is combusted within the combustion chamber 14 which is heated by the mixture of fuel gas and air which combusts near the exit surface 21 of the burner element 20.

Such combustion causes heating of the chamber 14 and provides combustion products, such as oxygen, typically within a range of 7.5% to 10.5%, depending on the air/fuel mixture [$CH_4$, $C_3H_8$, $C_4H_{10}$], provided to the combustion chamber 14. This heat and the combustion products react with the effluent gas stream within the combustion chamber 14 to clean the effluent gas stream. For example, and $SiH_4$ and $NH_3$ may be provided within the effluent gas stream, which reacts with $O_2$ within the combustion chamber 14 to generate $SiO_2$, $N_2$, $H_2O$, $NO_x$. Similarly, $N_2$, $CH_4$, $C_2F_6$ may be provided within the effluent gas stream, which reacts with $O_2$ within the combustion chamber 14 to generate $CO_2$, HF, $H_2O$.

Overview

Before discussing the embodiments in any more detail, first an overview will be provided.

As has been described previously, radiant burners are provided to treat effluent gases lei produces from various manufacturing processes. A simple radiant burner may be provided for treatment of chemical vapour deposition manufacturing processes of effluent gases. A radiant burner which includes a high-intensity flame at the end of an input nozzle may be provided as a suitable radiant burner to treat etching process effluent gases and, for example, epitaxial manufacturing processes may require the provision of a radiant burner which is capable of dealing with high flows of hydrogen.

In each case, the operating parameters of the radiant burner may be optimized to treat effluent gases produced by a manufacturing process.

A burner typically requires monitoring in order to ensure its safe operation. In known burners it may be that a flame ionisation detector is provided to monitor operation of a pilot flame and a thermocouple is provided to monitor combustion chamber 14 and the main radiant burner.

A thermocouple is typically not operable to discriminate between heat determined by a main radiant burner and any other energy source within the combustion zone.

Monitoring for whether the radiant burner itself is operational may be of use across all radiant burner types.

In a burner which is operable to treat effluent gases from epitaxial manufacturing processes, it will be understood that variable usage rates and semiconductor processing can lead to variable quantities of effluent gas which need to be processed. Maintaining efficient operation of a radiant burner is complex and whilst in some modes of operation a radiant burner may have to process large quantities of hydrogen, requiring a large flow of additional air, in other modes of operation a radiant burner may have to process material having hydrogen present in diminished quantities, requiring a low flow of air. Running large flows of air under all circumstances may result in poor combustion and thus high emissions of $CH_4$, CO and $H_2$. Furthermore, in such circumstances, a high flow of air without a correspondingly high hydrogen concentration may result in burner shut down as a result of low temperature. Running a low flow of air may also result in poor combustion leading to high emissions and inefficient burner operation. It will be appreciated that hydrogen and carbon monoxide emissions are an environmental concern and that ensuring efficient operation of a radiant burner may help to control such emissions.

In the case of a radiant burner arranged to treat effluent gases from etching processes, the presence of a high-intensity flame at the end of the nozzle may cause confusion or false positives in known monitoring techniques.

Aspects described herein recognise that a problem with operating a radiant burner according to a "standard" or "normal" set of operating parameters can lead to inefficient burner operation and that it is possible to provide a radiant burner which is operable to adjust operational parameters to address an increase or decrease in the flow rate of the effluent gas through the radiant burner, leading to an overall, improvement in radiant burner operation, by monitoring infrared radiation emitted by a burner combustion surface.

Accordingly, a gas abatement apparatus or radiant burner is provided. The radiant burner may treat an effluent gas stream from a manufacturing process tool. The radiant burner may comprise a combustion chamber. The combustion chamber may have a porous or permeable sleeve through which combustion materials pass. The combustion materials may combust proximate to, near to or adjacent a combustion surface of the porous sleeve. One or more effluent nozzles may be provided which eject the effluent gas stream into the combustion chamber. According to aspects described herein the radiant burner may further comprise a combustion characteristic monitor operable to determine combustion performance of the radiant burner by monitoring infra-red radiation emitted from the combustion surface. The radiant burner may also comprise a radiant burner controller operable to control operation of the radiant burner in dependence upon combustion performance determined by the combustion characteristic monitor.

Infrared light is determined as a function of operation of all radiant burners. The combustion zone proximate to a surface of the burner pad or burner surface 20 heats that material which, in turn, acts as a heat exchanger, heating the incoming effluent gases above their auto-ignition temperature.

Unlike a thermocouple, the infrared detector may be operable to discriminate between heat generated by a main radiant burner and other energy sources within the combustion zone.

In its simplest implementation, the infrared radiation emitted from the combustion surface may be used by the combustion characteristic monitor to determine whether or not the radiant burner is operational.

Further embodiments recognise that, whilst it may be beneficial to have precise details of the manufacturing process which is generating effluent gases to be processed by a radiant burner so that operating parameters of the radiant burner can be adjusted accordingly, that information may not always be available when configuring a radiant burner and may change over time, and the combustion characteristic monitor may provide a means to generate information which may be used to control operational parameters other than shut down or start up. Dependent upon the particular form of radiant burner, aspects particularly recognise that if a burner is suffering from excessive flows of air the burner pad or combustion surface will typically cool, which results in an increase in unwanted burner emissions and a reduction in infrared radiation generated by the combustion surface. The hydrogen flame provided at the nozzle of some radiant burners and the hydrocarbon flame of the burner pilot typically do not emit infrared radiation and thus a, change in infra-red radiation, for example, intensity, quantity or frequency, emitted by the combustion surface of the radiant burner can be used to diagnose an "overflow" of cold gas, typically air, in the combustion mixture fed into the system, for example, the combustion chamber. Once diagnosed appropriate ameliorative steps may be taken and, for example, the burner control logic may be operable to compensate by reducing air flow into the burner.

It will be appreciated, that by monitoring infra-red radiation emitted by the combustion pad, a non-invasive means of monitoring burner operation may be provided. That is to say, monitoring processes may be performed through, for example, an existing sight glass provided at a radiant burner. Aspects may therefore allow for burner monitoring without a need to directly interact with a process gas stream, or to provide monitoring sensors within the combustion chamber 14.

According to some embodiments, it is possible to use electromagnetic radiation emitted by the combustion surface, for example, radiation emitted in the UV and/or IR and/or visible part of the electromagnetic spectrum to carry out in situ spectroscopy. For example, $F_2$ or $Cl_2$ present in the combustion chamber will typically absorb UV radiation emitted by a burner pad; $CF_4$, $SiH_4$, CO, $CH_4$, will typically absorb IR radiation emitted by a burner pad. If an appropriate detector is provided and the electromagnetic radiation emitted by a combustion surface of a radiant burner is determined, it may be possible for an analysis unit to perform a degree of spectrographic analysis on the processes occurring in the combustion chamber and operation of the burner may be adjusted by a control unit in dependence upon signals received from the detector and analysis unit.

It will be understood that processes occurring within the combustion chamber as a result of effluent gas being fed to the radiant burner through inlets 10 may be monitored via spectrographic techniques. Appropriate look-up tables may, for example, be generated and those tables may be indicative of optimal burner operation in respect of a particular effluent flow from a processing tool. It may, for example, be possible to adjust radiant burner operational characteristics (for example, fuel flow or the mixing of fuel or oxidant with the effluent gas to optimise the processes which occur in the combustion chamber which may be monitored in more detail as a result of spectroscopy.

FIG. 2 illustrates schematically some components of a radiant burner according to one embodiment. Reference numerals have been re-used for components identical to those shown in FIG. 1 as appropriate.

The radiant burner 8 shown schematically in FIG. 2 comprises an infrared detector 200 arranged to observe infra-red radiation emitted by burner combustion surface 21. The detector 200 is coupled to an analysis unit 210 comprising analysis logic operable to perform appropriate calculations on measurements made by detector 200. Calculations performed by analysis unit 210 may alter in dependence upon choice of implementation made by a user on initial configuration of monitoring and control of the radiant burner.

The analysis unit 210 is coupled to a burner control unit 220 comprising control logic operable to control a flow of combustible material into the burner, for example, fuel or gas, and/or air in dependence upon analysis completed by the analysis unit 220. In the embodiment shown schematically in FIG. 2, the burner control unit 220 is operable to control a gas valve 240 and an air valve 230, respectively operable to control rate of flow of each of gas and air to the burner. In the embodiment shown in FIG. 2, the valves may be used to stop fuel and air flow to the burner in the event that infrared radiation detected is determined to have fallen below a predetermined threshold indicative of safe burner operation.

It will be appreciated that operation of the valves 230, 240 may also be used to change a ratio of gas and air forming a combustion mix fed to the burner, if the burner were to be used, for example, to treat effluent gas from epitaxial manufacturing processes.

Various implementations of monitoring and control parameters are possible. Some possible implementations are described, in more detail below:

The infrared detector or sensor 200 may be used to monitor infra-red radiation emitted by a combustion, surface of a radiant burner. If the analysis unit 210 determines that the signal received from detector 200 is indicative of burner pad (combustion surface) cooling, an appropriate signal may be sent or received by control unit 220 and, according to some embodiments, the control unit may be operable to signal to air control valve 230 to adjust the flow of air to the burner such that excess air is switched off.

Accordingly, an infra-red detector may be used as a switch and signals received from the detector may be interpreted as either meeting, or not meeting, a preselected, parameter indicative of optimal burner operation.

In an alternative embodiment, infra-red sensor 200 may be used as an analogue device, according to which an infra-red emission range may be indicative of optimal burner operation and additional air blowers 230 may be controlled by control unit 220 and instructed to speed up or slow down to achieve an infra-red emission detected to lie within the desired infra-red emission range. It will, be appreciated that appropriate characterisation of a radiant burner may be required in order to implement appropriate control and monitoring parameters to ensure optimised radiant burner operation. Such characterisation of a radiant burner may, for example, take into account hysteresis characteristics of the combustion surface.

For example the intensity of the signal, from one or more wavelengths from the range 400 nm to 1100 nm can be monitored with the signal around 800 nm being the most intense.

It will be appreciated that a person of skill in the art would readily recognize that steps of various above-described methods can be performed by programmed computers. Herein, some embodiments are also intended, to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labeled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes winch may be substantially represented in computer readable medium and so executed by a computer or processor, whether or not such computer or processor is explicitly shown.

Although illustrative embodiments of the invention have been disclosed in detail herein, with reference to the accompanying drawings, it is understood that the invention is not in limited to the precise embodiment and that various changes and modifications can be effected therein by one skilled in the art without departing from the scope of the invention as defined by the appended claims and their equivalents.

The invention claimed is:

1. A radiant burner for treating an effluent gas stream from a manufacturing process tool, the radiant burner comprising:

(a) a combustion chamber having a porous sleeve through which combustion materials pass for combustion proximate to a combustion surface of the porous sleeve;

(b) a combustion characteristic monitor mounted in a non-invasive manner relative to the combustion chamber and operable to determine combustion performance of the radiant burner by monitoring infra-red radiation emitted from the combustion surface; and (c) a radiant burner controller operable to control operation of the radiant burner in dependence upon combustion performance determined by the combustion characteristic monitor;

wherein the combustion characteristic monitor is operable to determine combustion performance of the radiant burner by monitoring intensity of radiation received at one or more infra-red radiation wavelengths indicative of desired operation parameters of the radiant burner at that wavelength.

2. The radiant burner of claim 1, wherein the combustion characteristic monitor is operable to determine whether the infra-red radiation emitted by the combustion surface lies within acceptable operational parameters.

3. The radiant burner of claim 2, wherein if the combustion performance determined by the combustion characteristic monitor is determined to lie outside the acceptable operational parameters, then the radiant burner controller is operable to initiate one or more ameliorative actions.

4. The radiant burner of claim 3, wherein the ameliorative actions include initiation of a radiant burner shutdown and/or activation of a user alarm.

5. The radiant burner of claim 1, wherein the radiant burner controller is operable to control the combustion materials fed to the radiant burner combustion surface in dependence upon the combustion performance determined by the combustion characteristic monitor.

6. The radiant burner of claim 1, wherein the radiant burner controller is operable to increase or decrease a feed rate of the combustion materials fed to the radiant burner combustion surface in dependence upon the combustion performance determined by the combustion characteristic monitor.

7. The radiant burner of claim 1, wherein the radiant burner controller is operable to control a composition of the combustion materials fed to the radiant burner combustion surface in dependence upon the combustion performance determined by the combustion characteristic monitor.

8. The radiant burner of claim 1, wherein the radiant burner controller is operable to increase or decrease a ratio of fuel to air in the combustion materials fed to the radiant burner combustion surface in dependence upon the combustion performance determined by the combustion characteristic monitor.

9. The radiant burner of claim 1, wherein the combustion characteristic monitor is operable to determine combustion performance of the radiant burner by monitoring one or more infra-red radiation wavelength indicative of desired operation parameters of the radiant burner.

10. The radiant burner of claim 1, wherein the combustion characteristic monitor is operable to monitor electromagnetic radiation emitted by the combustion surface and determine combustion performance of the radiant burner by performing spectroscopic analysis in relation to that monitored electromagnetic spectrum.

11. The radiant burner of claim 1, wherein the combustion characteristic monitor and the radiant burner controller are operable to continuously monitor and control operation of the radiant burner thereby operating to form a feedback loop of operation.

* * * * *